United States Patent [19]

Roth et al.

[11] Patent Number: 4,514,350

[45] Date of Patent: Apr. 30, 1985

[54] METHOD FOR MELT SPINNING POLYESTER FILAMENTS

[75] Inventors: Douglas D. Roth, Matthews; Fredrick A. Ethridge, Waxhaw, both of N.C.

[73] Assignee: Celanese Corporation, New York, N.Y.

[21] Appl. No.: 422,116

[22] Filed: Sep. 23, 1982

[51] Int. Cl.[3] ..... B29F 3/04

[52] U.S. Cl. ..... 264/176 F; 425/72 S; 425/464

[58] Field of Search ..... 425/464, 72 S, 378 S, 425/379 S, 382.2; 264/176 F, 237

[56] References Cited

U.S. PATENT DOCUMENTS

| | | | |
|---|---|---|---|
| 2,030,972 | 2/1936 | Dreyfus | 264/188 |
| 2,273,105 | 2/1942 | Heckart | 264/176 F |
| 2,766,479 | 10/1956 | Henning | 264/174 |
| 2,968,834 | 1/1961 | Groombridge et al. | 425/72 S |
| 3,293,696 | 12/1966 | Bruni | 264/176 F |
| 3,307,216 | 3/1967 | Dunn et al. | 264/176 F |
| 3,311,688 | 3/1967 | Schuller | 264/176 F |
| 3,335,210 | 8/1967 | Vinicki | 264/176 F |
| 3,375,548 | 4/1968 | Kido et al. | 264/171 |
| 3,457,341 | 7/1969 | Duncan et al. | 264/103 |
| 3,457,342 | 7/1969 | Parr et al. | 264/171 |
| 3,628,930 | 12/1971 | Harris | 65/12 |
| 3,867,082 | 2/1975 | Lambertus | 425/464 |
| 3,965,664 | 6/1976 | Goetti et al. | 57/157 R |
| 4,104,015 | 8/1978 | Meyer | 425/382.2 |
| 4,123,208 | 10/1978 | Klaver et al. | 425/72 S |
| 4,248,577 | 2/1981 | Bory | 264/176 F |
| 4,248,581 | 2/1981 | Harrison | 246/176 F |
| 4,259,048 | 3/1981 | Miani | 264/237 |
| 4,283,364 | 8/1981 | Capps et al. | 264/176 F |
| 4,327,050 | 4/1982 | Salmon | 425/464 |
| 4,332,764 | 6/1982 | Brayford et al. | 264/176 F |

FOREIGN PATENT DOCUMENTS

| | | | |
|---|---|---|---|
| 52-63418 | 5/1977 | Japan | 264/237 |
| 419485 | 3/1974 | U.S.S.R. . | |

OTHER PUBLICATIONS

"Model of Steady State Melt Spinning at Intermediate Takeup Speed", Polymer Eng. & Sci., by H. George, vol. 22, No. 5, pp. 292–299, 5–1982.

"Fundamentals of Fiber Formation", by Ziabicki, John Wiley, 1976: pp. 142–148, (Melt Spinning).

"J. of Polymer Sci.", vol. II, pp. 251–287, (1967).

*Primary Examiner*—James Lowe

*Attorney, Agent, or Firm*—S. M. Bodenheimer, Jr.

[57] ABSTRACT

A melt-extrusion process is disclosed for reducing the birefringence variability of melt-spun yarn made at high pack throughputs. It involves extruding polymer at an average mass-flow rate through a first group of orifices (defined by specific location in the spinnerette), that is greater than the mass-flow rate of polymer through a second group of orifices (also defined by location in the spinnerette). It is preferred that a spinnerette be used in which the dimensions of the orifices differ from group to group in a defined manner.

11 Claims, 14 Drawing Figures

(Derived From Prior Art)

(Derived From Prior Art)

Figure 6A
(Prior Art)
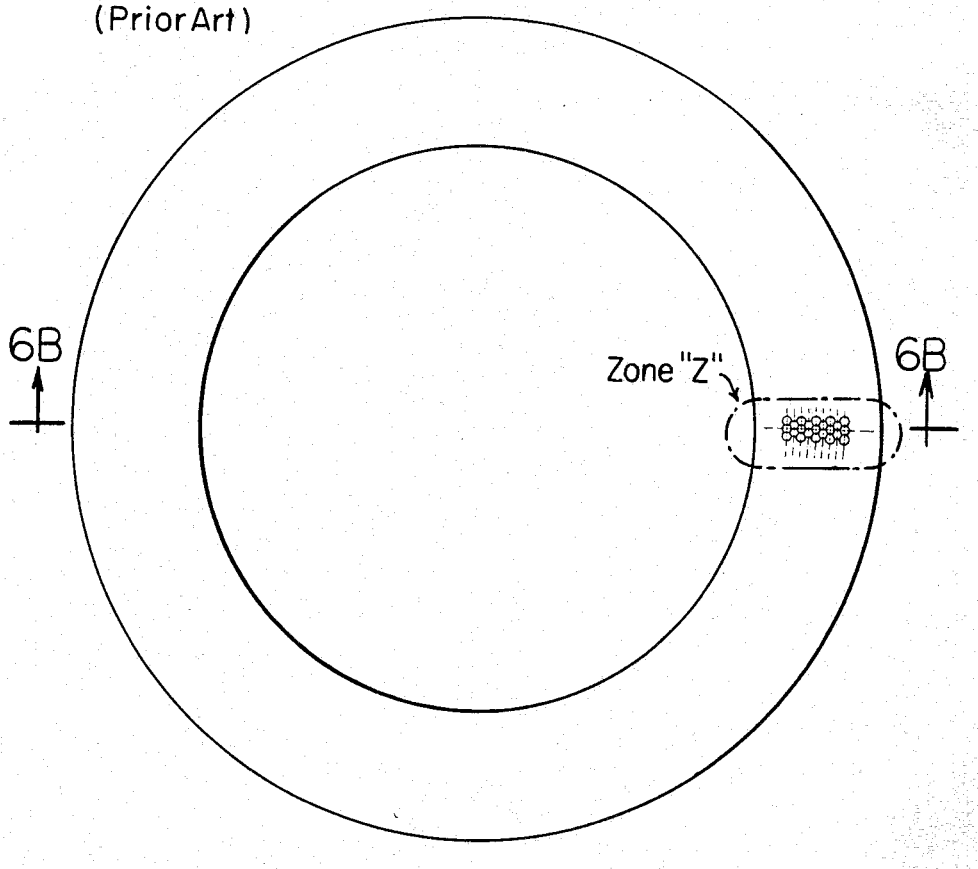
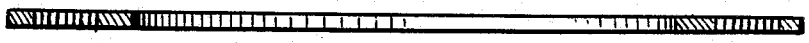
Figure 6B
(Prior Art)

METHOD FOR MELT SPINNING POLYESTER FILAMENTS

BACKGROUND

1. Field of the Invention

The present invention relates generally to the manufacture of melt-spun polymeric filaments. More particularly, it relates to the manufacture of polyester filaments by a process involving the use of an improved spinnerette. The improved spinnerette has groups of orifices with specifically defined unequal dimensions from group to group, rather than similar dimensions. It also relates to the improved filamentary product thereby obtained, particularly at high extrusion rates of molten polymer through the pack containing the spinnerette.

2. Prior Art

The manufacture of melt-spun polymeric filaments is extremely old in the art. Typically, a molten polymer (such as polyester, polyamide and polyolefin) is extruded downwardly through a plurality of orifices in the spinnerette to form molten filaments. The extruded filaments are simultaneously cooled in a quench zone and stretched (by yarn haul-off means such as a yarn winder) into finer filaments having at least some molecular orientation (expressed as birefringence, $\Delta n$).

High variability of molecular orientation of the melt-spun filaments is also well-known to affect deleteriously downstream processes and/or the properties of downstream products made therefrom, such as drawn yarns. It is also well known that high productivity processes (e.g., involving the extrusion of several hundred pounds of molten polymer each hour through a single spinnerette) tend to result in the production of filaments having higher birefringence variability than filaments made at lower extrusion rates. There is thus a problem in maintaining the quality of the melt-spun yarn when production rates are increased. U.S. Pat. No. 4,332,764 (Brayford and Cardell) discloses one method of reducing birefringence variability in polyester filaments melt-spun at several hundred pounds per hour.

All prior art relating to the melt-spinning of polyester polymer into filaments has apparently involved the use of spinnerettes in which the corresponding dimensions of the individual orifices within the spinnerette have been essentially equal within machinable tolerance limits. This is perhaps not surprising since (i) high birefringence variability is often associated with high denier variability; and (ii) variations between orifices causes denier variability.

Two major classes of prior art relative to the invention claimed hereinafter are discussed below. The first class of prior art relates primarily to theories and mathematical models that have been advanced. The second class of prior art relates primarily to concrete experimental data from the patent literature.

Within the first class of prior art, many attempts have been made to understand the science of melt-spinning polyester polymer. One recent comprehensive publication in the subject area is "Model of Steady-State Melt Spinning at Intermediate Take-Up Speeds" by Dr. H. H. George, published in April 1982 by "Polymer Engineering and Science". Dr. George also gave an oral presentation in Hawaii in 1979 on a related topic. Another publication of interest is "Fundamentals of Fibre Formation" by Andrzej Ziabicki, published by John Wiley & Sons in 1976. Pages 149–248 relate to melt-spinning. An older publication of interest is "Studies on Melt-Spinning. II. Steady State and Transient Solutions of Fundamental Equations Compared with Experimental Results" by Susumu Kase and Tatsuki Matsuo, found in the "Journal of Applied Polymer Science", Volume 11 at pages 251–287 (1967). While all the foregoing publications are valuable contributions to developing a qualitative understanding of the science of melt-spinning polyester polymer, it is believed not unfair to state they still fall far short of enabling a research worker to predict how to further reduce birefringence variability in high productivity processes such as that disclosed in the Brayford and Cardell patent. This is so for reasons including the following. Firstly, all the models are based upon a large number of simplifying assumptions. Secondly, a very large number of interdependent variables are involved in the various mathematical formulae and, as a result, the models tend to have value in predicting qualitative trends under single filament steady state conditions, rather than quantitative trends under multifilament transient conditions. Nonetheless, at least two aspects of the theories developed in the foregoing publications are at least of interest to the instant invention. In particular, firstly, it is well known that increasing the diameter of a circular orifice in a melt-spinning process involving the extrusion of a single filament, without introducing any other changes to independent variables, thereby decreases the extrusion velocity of the filament from the spinnerette; reduces the pressure drop across the orifice; reduces the extrusion temperature; has no effect on take-up speed or take-up denier; increases the final tension of the filament at take-up; and increases the final birefringence of the filament. Secondly, some models suggest that there is a correlation at each and every point in the spinning threadline between the birefringence and the stress at the same point, expressed in grams per denier. Further, George suggests that the foregoing correlation is, in fact, unique. In which case, George's equations lend themselves to predicting what compensatory changes might be made in a pair of groups of filaments when the first group of filaments is subjected to different quench conditions from the second group of filaments. Nevertheless, the fact remains, that the prior art does not show any extrusion of molten polyester polymer through a spinnerette having orifices of differing dimensions within the single spinnerette. Further, the equations of the published prior art cannot be used to accurately predict the actual changes in filament denier that occur as a result of so-doing. Even less, therefore, can they be used to predict the resultant compensatory effects in birefringence. In addition, the prior art teaches that high transverse air quench rates across a single filament result in the filament having asymmetric birefringence across the filament in the direction of quench gas flow. There is, inevitably, a tendency for asymmetric birefringence to occur at the very high cross flow quench rates required when spinning molten polyester at very high throughputs. Accordingly, the foregoing models are, at best, believed to be a guide post concerning the nature of experiments that might perhaps be performed in order to reduce the birefringence variability of polyester melt-spun filaments.

Within the second class of prior art defined above, several patents discussed below are, at least, of interest to the present invention.

Firstly, U.S. Pat. No. 4,248,581 (Harrison) also addresses the problem of obtaining filaments with uniform physical properties in high throughput, high filament density melt-spinning processes. The patent points out that the prior art recognizes that uniform, turbulence-free quenching of filaments is an important factor in the production of filaments having uniform physical properties, a prerequisite to acceptable performance of fibers in subsequent processes. It also points out that this is difficult to achieve in the cross-flow quench system, typically linked to a high throughput and high filament density melt-spinning process, as the traverse path of the quenching fluid causes it to contact first one side of the filament bundle and then pass therethrough. Those filaments most remote (downstream) from the entry of the quench fluid are cooled or solidified by a quench flow which has been pre-heated, made more turbulent and substantially diminished (via a downward moving boundary layer) by the obstruction presented by filaments closer to and previously contacted by the quench fluid. As a consequence, the cooling rate of the filaments is progressively slower as quench fluid passes through the filament bundle. The patent further points out that the ideal solution to quench irregularity would be to increase the spacing of spinnerette orifices, resulting in increased distance between filaments for quenching. However, there are practical restraints to the increase in orifice spacing in a spinnerette of given diameter and orifice count. The patent then points out that the prior art has attempted to solve quench irregularity by rearranging the positions of the spinnerette orifices within the spinnerette plate. For example, it discusses the use of "V" patterns, concentric circles, crescent formations, rectangular grids, and irregular arrangements whereby the spinnerette orifices are staggered so that each one is located in the quench flow path without obstruction. It also discusses the use of spinnerette orifices arranged in parallel rows, such that the orifices in a given row are equally spaced and the distance between adjacent rows is less than the distance between the orifices in each row. The invention disclosed in the '581 patent also relates to a spinnerette in which the orifices are arranged in a specific configuration. Nowhere does the patent remotely suggest the possibility of varying the dimensions from orifice to orifice within the spinnerette in order to improve the uniformity of the final product.

Secondly, U.S. Pat. No. 4,104,015 (Meyer) also addresses the problem of filament non-uniformity. In particular, the patent points out (at column 1, beginning at line 23) that one of the most significant factors contributing to filament non-uniformity during the melt-spinning process is the fact that the temperature of the molten polymer passing through the orifices positioned near the center of the spinnerette is higher as compared to the temperature of the molten polymer passing through the orifices positioned near the edge of the spinnerette. The higher the temperature of the polymer, the lower the viscosity; and the lower the viscosity the faster the polymer under a given pressure passes through an orifice of the spinnerette. Therefore, because of the temperature differential across the face of the spinnerette, the flow rate of the molten polymer through the orifices of the spinnerette varies, and this results in filament (denier) non-uniformity. Although attempts have been made to reduce the temperature differential across the face of the spinnerette and thus improve the uniformity of the filaments, non-uniformity is still a problem. The invention of the '015 patent essentially amounts to the use of an improved bridge plate in which the position of the orifices are adjusted to adjust the pressure above each spinnerette orifice. Thereby the temperature non-uniformity is compensated. It should also be noted that Applicants' assignee commercially used in secret in the 1960's a process involving a somewhat different solution. In particular, in the spinning of nylon 6,6 polymer, observed temperature differentials across the face of the spinnerette were in part compensated for by enlarging the orifices in the cooler portion of the spinnerette. The inventors of the instant invention were unaware of that old work at the time that they conceived their invention and initially reduced it to practice. Further, it should be noted that the work on nylon 6,6 involved enlarging the orifices remote from the quench source (in contrast to the instant invention that is described hereinafter). Further, it should be noted that the work on nylon 6,6 involved the production of continuous filament yarn from relatively small packs at relatively low polymer throughputs per square inch of spinnerette face (in contrast to the invention described hereinafter in which high polymer throughputs per square inch of spinnerette face are used).

Thirdly, U.S. Pat. No. 2,766,479 (Henning) is of interest in that FIG. 3 discloses a plate having orifices of different size therein. The patent relates to the extrusion of cellular plastics upon filamentary conductors. It is pointed out that in order to prevent premature gas expansion within the confines of the extruder, it is important that the temperatures within the extruder and the dye should be accurately regulated, and that the rate of extrusion and the linear speed of the conductive core be adjusted suitably. This may be accomplished by creating a back pressure within the extruder to prevent premature expansion of the gas therein. The plate shown in Henning's FIG. 3 merely relates to such a plate that creates back pressure against the extruder screw and is positioned upstream of the extrusion dye.

Fourthly, U.S. Pat. No. 3,628,930 (Harris) also discloses a baffle plate upstream of the spinnerette, apparently in order to control melt pressure above the spinnerette orifices, which spinnerette orifices appear to be of uniform size.

Fifthly, U.S. Pat. No. 2,030,972 (Dreyfus) discloses in FIG. 2 a spinnerette which at first sight might appear to have larger orifices 16 in the outer ring than orifices 17 in the inner ring. The text of the patent, however, does not confirm this. Indeed, it is pointed out "the size of the orifices is much exaggerated" (page 2, column 2, lines 5–6).

Sixthly, U.S. Pat. No. 3,457,342 (Parr et al) discloses a plate upstream of a spinnerette in which the orifices 15 are smaller in size than the orifices 14 (see FIGS. 2 and 3, in particular). However, the extrusion orifices 3 all appear to have similar dimensions.

Seventhly, U.S. Pat. No. 3,375,548 (Kido et al) discloses in FIG. 1 a pack for producing conjugated filaments in which the spinning orifices 14 are fed with polymer from two other upstream orifices 21 and 22, which orifices 21 and 22 apparently may differ in size. However, there appears to be no suggestion that spinnerette orifices 14 should have different dimensions from each other.

Eighthly, several U.S. patents originally thought to be of interest are believed to be less pertinent than the aforementioned prior art. They are U.S. Pat. Nos. 4,123,208 (Klaver et al); 3,867,082 (Lambertus et al); and 3,311,688 (Schuller).

Ninthly, some patents relate to filamentary products deliberately made with mixed filament deniers. For example, U.S. Pat. No. 3,965,664 (Goetti et al) relates to a spun yarn made from a mix of staple fibers, in which the mix is formed from staple fibers of at least three different titers. The patent further teaches generally that the synthetic plastic fibers may, for instance, be of the type extruded from orifices of different size or different cross-section (at column 3, lines 17–19). There is, however, no specific exemplification thereof. Even less is there any recognition of criticality concerning the location of the larger orifices relative to the location of the smaller orifices.

Tenthly, Russian Pat. No. 419,485 is understood to disclose that the packing density of glass fibers is increased by having a mix of widely different deniers; and that such a product can be made by using a spinnerette having a mixture of orifice sizes. However, glass is not a polymeric orientatable material.

In sum, nowhere does the prior art disclose or suggest the invention claimed hereinafter.

SUMMARY OF THE INVENTION

In contrast to the forementioned prior art, it has now been surprisingly discovered that spinnerettes having so-called "graduated orifice sizes" (GOS) have in fact significant utility in manufacturing melt-spun filaments with good birefringence uniformity at high polymer extrusion rates. The invention involves extruding polymer at an average mass-flow rate through a first group of orifices (defined by specific location in the spinnerette), that is more than the average mass-flow rate of polymer through a second group of orifices (also defined by specific location in the spinnerette).

BRIEF DESCRIPTION OF THE DRAWINGS

FIG. 6A is a plan view of a spinnerette of the prior art.

FIG. 6B is an elevation view in Section 6B6B of FIG. 6A.

DESCRIPTION OF THE PREFERRED EMBODIMENTS

The preferred embodiments of the invention are best understood if, in addition to examples of the invention, a discussion is included as to how the invention was made and comparative examples are included.

Figure 1:
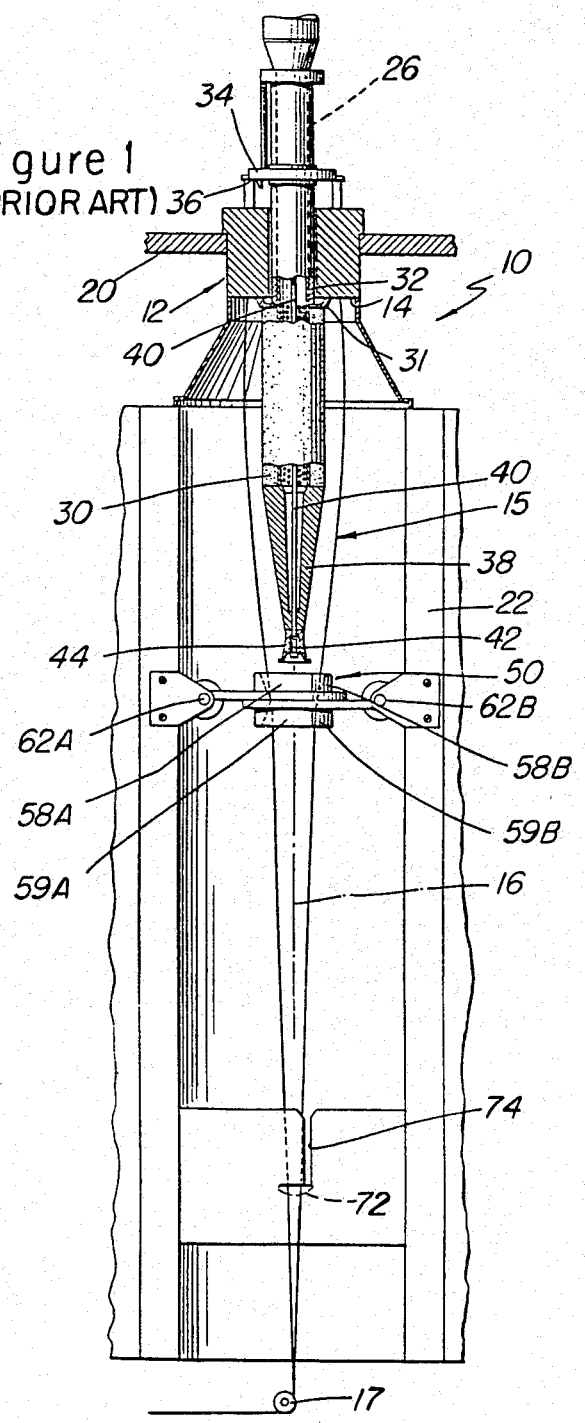
Figure 1 (PRIOR ART)
FIG. 1 is a front elevation view of prior art apparatus and process for melt-spinning polyester filaments with reduced birefringence variability (as shown in U.S. Pat. No. 4,332,764).

The invention arose out of an attempt to (1) better understand the science of melt-spinning poly(ethylene terephthalate) polymer through a large number of closely spaced spinnerette orifices (a typical prerequisite for high productivity processes); and (2) use these findings to further improve quality and/or productivity of such processes, including processes of the type shown semi-schematically in FIG. 1.

For example, an attempt was made to understand why the typical birefringence variability of yarn melt-spun from a spinnerette having 2,250 orifices arranged in nine circular rows was significantly higher than the corresponding birefringence variability of yarn melt-spun from a spinnerette having 1,904 orifices arranged in seven circular rows. Thermocouple measurements of quench air during the melt-spinning showed that the temperature of the air rose significantly as it passed through the filaments. For example, with the nine row spinnerette, the air temperature close to the spinnerette typically rose from 32° C. to 120° C. in travelling a distance of less than 1 inch as it passed radially outwards between the filaments. Computer modeling of the inside and outside rows of filaments was performed using the model developed by Dr. George discussed above. That analysis revealed that changes in the quench air temperature and velocity could result in a considerable birefringence bias across the bundle. At the same time, however, the computer (steady state) model predicted a theoretical birefringence variability that was, in fact, significantly lower than the observed birefringence variability (which reflects transient and steady state conditions). According to the computer model (so-called Spin 1 model) the average birefringence would vary from $5.79\times10^{-3}$ for the inside row of filaments to $4.77\times10^{-3}$ for the outside row of filaments in a specific melt-spinning process involving the extrusion of 170 lbs. of polymer per hour through a 2,250 orifice spinnerette and collecting the yarn at 3,000 feet/minute. The question was then posed as to whether this bias of birefringence could be corrected or compensated by introducing a countervailing birefringence effect at the spinnerette. It was concluded that theoretically such a counter bias might be obtained by varying either the spinnerette (polymer) temperature from inside to outside the pack, or the orifice dimensions from inside to outside the pack.

Firstly, it was noted that that the through-pack quench design as shown in FIG. 1 afforded the opportunity to place a heater inside the pack and create a radial temperature gradient. Computer modeling using the Spin 1 program suggested that it would make sense, at least theoretically, to attempt to increase the temperature of the polymer melt-spun through the inner ring of orifices by 9° C. relative to the temperature of the polymer melt-spun through the outermost ring of orifices. However, practically, it was then appreciated that the heating effect would probably not penetrate far enough into the flowing polymer to affect more than the inside one or two rows of filaments. Also, it would be difficult to control the temperature profile from pack position to pack position, and with time for any given pack position. In effect, in order to achieve the desired temperature profile, it would be necessary to redesign the whole polymer delivery system and include a number of separately controllable heating units.

Figure 3:
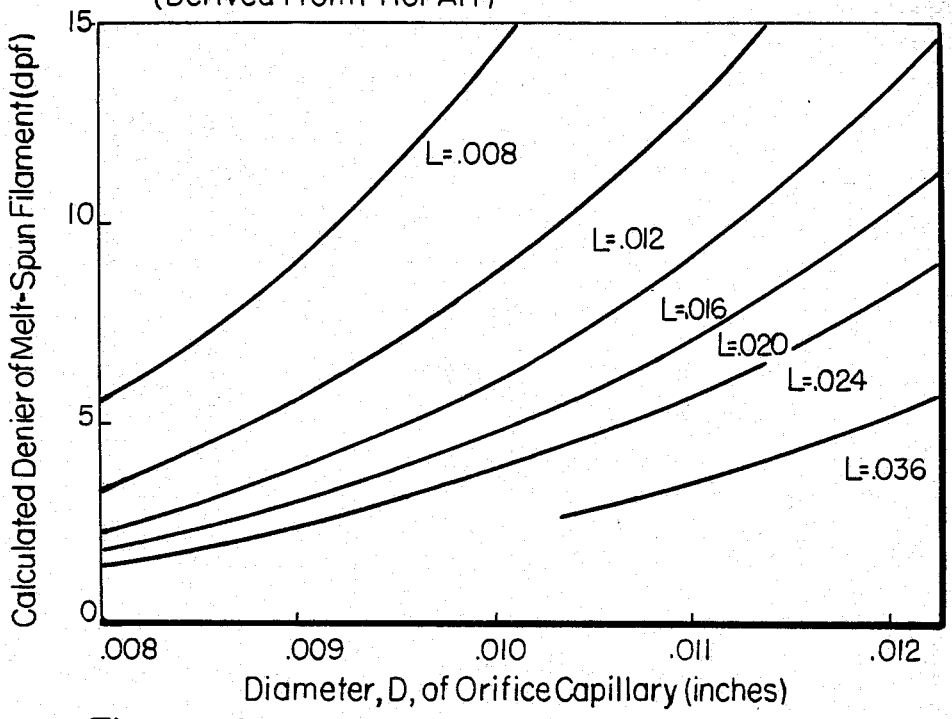
FIGS. 3 and 4 are charts derived from prior art and depict how the properties of a single melt-spun polyester filament (filament dpf and filament birefringence) depend upon the values of parameters in melt-spinning processes.
Figure 4:
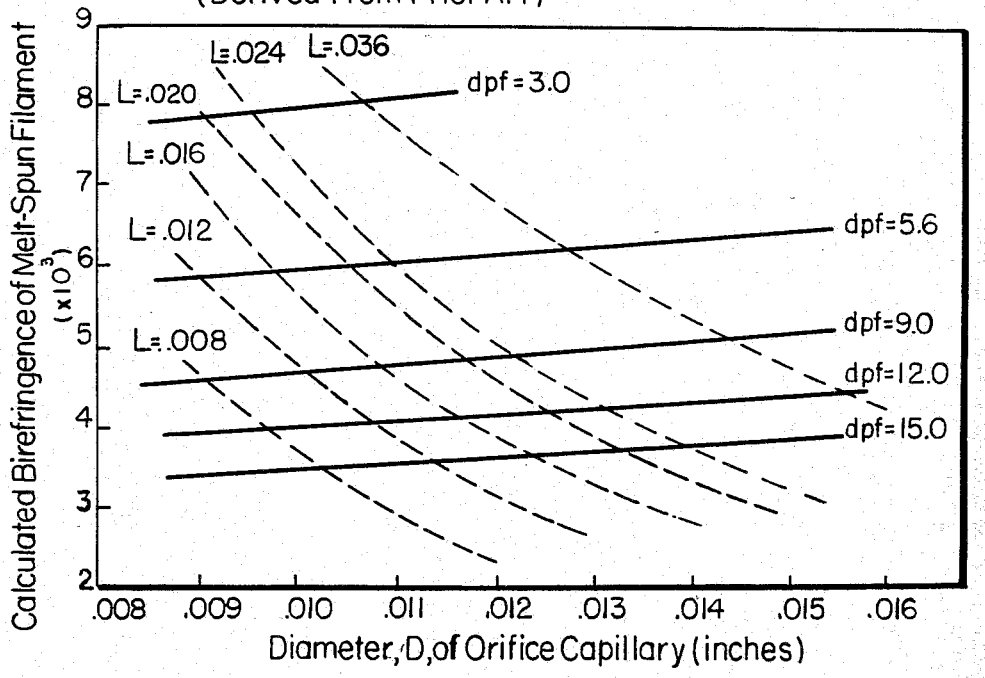

Attention was therefore turned to the secondly proposed possible approach of varying the orifice dimensions across the spinnerette, notwithstanding the inherent inflexibility built into such a technique. It was concluded that the simplest way of performing an experiment would be to enlarge some orifices of a pre-existing spinnerette having 2,250 orifice capillaries of length 0.012 inch and diameter 0.009 inch. Inevitably, such enlargement of diameter also resulted in marginal increase of capillary length because of the pre-existing counterbore (see FIG. 6D). However, this was a secondary effect. The first step was then to determine spun dpf as a function of orifice dimensions. FIG. 3 shows a graph of calculated spun dpf for circular capillary orifices having different diameters (D inches) and different lengths (L inches), for poly(ethylene terephthalate) polymer having an intrinsic viscosity of 0.62 deciliters/gram, melt-spun at a temperature of 295° C. and a pressure drop of 386 psi across the orifice capillary, quenched in radial outflow manner by air fed at a temperature of 32° C. and at a rate of 350 SCFM, and wound up at a speed of 3,000 feet/minute. From the foregoing dpf values and the Spin 1 program, the corresponding values of birefringence were calculated as shown in FIG. 4. From FIG. 4 it was concluded that the diameter of the orifices of the inside row should be enlarged to 0.010 inches in order to reduce the birefringence from 5.79 to 4.77. Note also that the projected dpf simultaneously increased from 5.6 to 8.8. At that point in time it was not known what to do with the intermediate rows between the innermost and outermost rows, since it was not known how the quench variation affected the birefringence profile. Accordingly, it was assumed (as a first approximation) that the birefringence varied linearly between the innermost row (row 1) and the outermost row (row 9), as shown in Table 1 below.

TABLE 1

| | PROFILES OF BIREFRINGENCE AND ORIFICE DIAMETER | | | | | | | | |
|---|---|---|---|---|---|---|---|---|---|
| ROW NO. | 1 | 2 | 3 | 4 | 5 | 6 | 7 | 8 | 9 |
| Assumed Prior Art $\Delta n \times 10^3$ | 5.79 | 5.66 | 5.54 | 5.41 | 5.28 | 5.15 | 5.02 | 4.90 | 4.77 |
| Ideal Dia. of Orifices (in.) | .0100 | .0098 | .0097 | .0096 | .0094 | .0093 | .0092 | .0091 | .0090 |
| Practical Dia. of Orifices (in.) | .0100 | .0100 | .0100 | .0095 | .0095 | .0095 | .0090 | .0090 | .0090 |
| Corrected $\Delta n \times 10^3$ | 4.77 | 4.64 | 4.52 | 4.93 | 4.80 | 4.67 | 5.02 | 4.90 | 4.77 |

Figure 5:
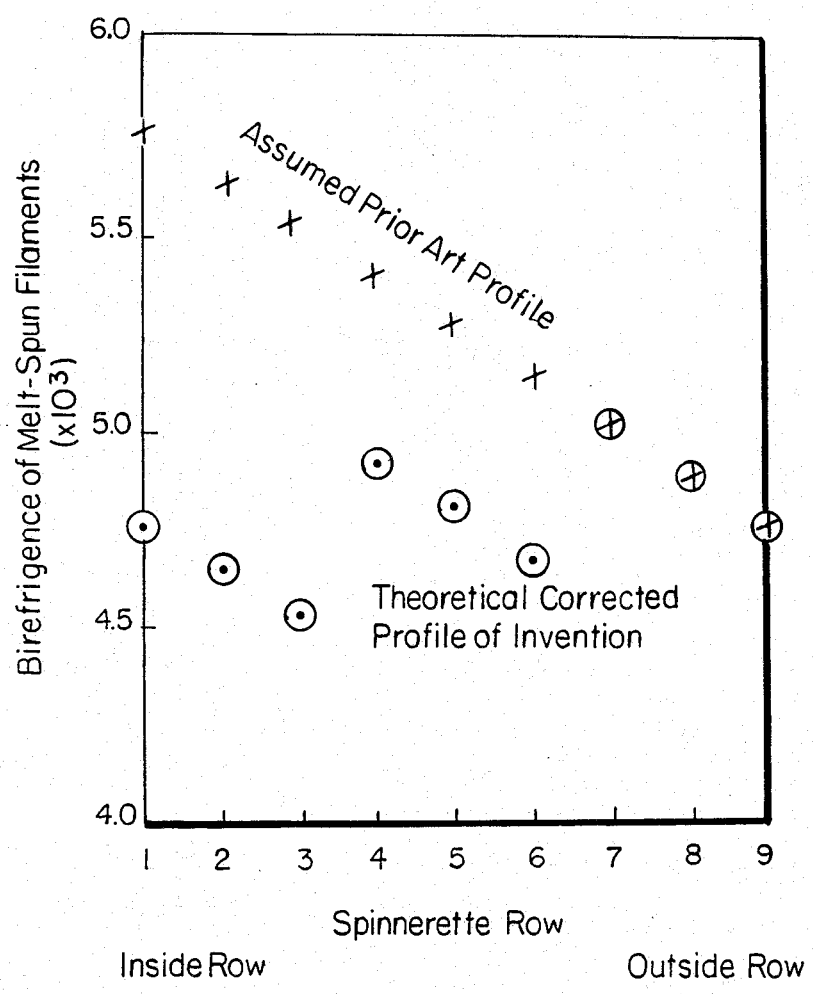
FIG. 5 is a theoretical chart showing how, under certain assumptions, the variability of spun yarn birefringence of filaments melt-spun from a practical nine row spinnerette of the invention (proposed in Table 1) might be lower than that from a prior art spinnerette.

From FIG. 4, the "ideal orifice size" was then determined for each of the intermediate rows 2 thru 8, which would reduce the birefringence of the filaments of each row to $4.77 \times 10^{-3}$. It was further recognized that it is not feasible to have a different diameter for the orifices of each row of orifices, on account of practical tolerance limitations. Accordingly, the Table 1 above also includes "practical orifice size" profile, which consists of three different orifice sizes across the spinnerette. Also shown in the table is the theoretical corrected birefringence profile when the practical orifice size distribution is used. Both the uncorrected and corrected birefringence profiles are shown in FIG. 5. Accordingly, theoretically, the birefringence CV could be reduced from 6.4 percent to 3.2 percent (assuming no short term variability along the threadline due to transient conditions).

Thereafter, a 2,250 orifice spinnerette was modified according to the "practical orifice size" profile as shown in Table 1 above. A first trial was then performed with a graduated orifice size (GOS) spinnerette in which the inside three rows of orifices had a diameter enlarged to 0.010 inches, the middle three rows enlarged to 0.0095 inches, and the outside three rows remained at 0.009 inches. Use of the spinnerette resulted in spun yarn with very good birefringence uniformity and very good elongation uniformity. In general, there is a reasonable correlation between birefringence variability and elongation variability. In particular, the birefringence CV's were in the 4–5% range for yarn collected at 3,000 feet/minute. As expected, the different orifice sizes resulted in a higher dpf variability.

In a second trial, the GOS spinnerette was compared to a standard 2250 orifice spinnerette. Hot weather and inadequate quench air cooling caused the spun yarn variability to be higher than expected. However, the GOS spinnerette produced spun yarn with lower birefringence CV and lower elongation CV than the standard spinnerette used under corresponding conditions. An improved quench air cooling system was then installed to ensure adequate control of the quench inlet temperature. Because of the problems encountered in quench temperature control, it was not then clear whether the GOS spun yarn had the same birefringence level as melt-spun yarn made with a standard spinnerette. It was important, however, that this should be determined because it would have a profound effect on the ease with which this technique could be implemented in a pre-existing production plant. Clearly, the GOS product would be mergeable with the standard product only if its birefringence were the same as that of the standard product.

During the course of the foregoing trials, experiments were performed to determine the birefringence variability of yarn melt-spun under a wide range of process conditions. In particular, the effect of the following variables was determined: yarn collection speed over the range 3,000 feet/minute to 7,000 feet/minute; air quench flow rate over the range 175 SCFM to 350 SCFM; closest position of the quench unit source to the spinnerette (quench spacing) over the range 1 inch to 3 inches; and different methods of applying the spin finish with the melt-spun filaments. Essentially, the only problem found with the GOS spinnerette was that it overcompensated for the pre-existing birefringence bias at speeds around 7,000 feet/minute. Accordingly, the specific spinnerette used in the trials appeared to have significant utility only in the speed range from, say, 1,500 feet/minute to 5,000 feet/minute. As a result of the work already done, however, it is believed that there would be no problem in designing the spinnerette that would be effective over the speed range of from 5,000 feet/minute to 10,000 feet/minute. At speeds in excess of 10,000 feet/minute, however, when the melt-spun yarn tends to be crystalline in addition to being partially oriented, somewhat different computer models are required because of the formation of crystallites. It would be expected, however, that GOS spinnerettes might also have utility under those conditions.

Comparative examples and examples of the invention are given below.

EXAMPLES 1-31 AND COMPARATIVE EXAMPLES C13-C31

Figure 2A:
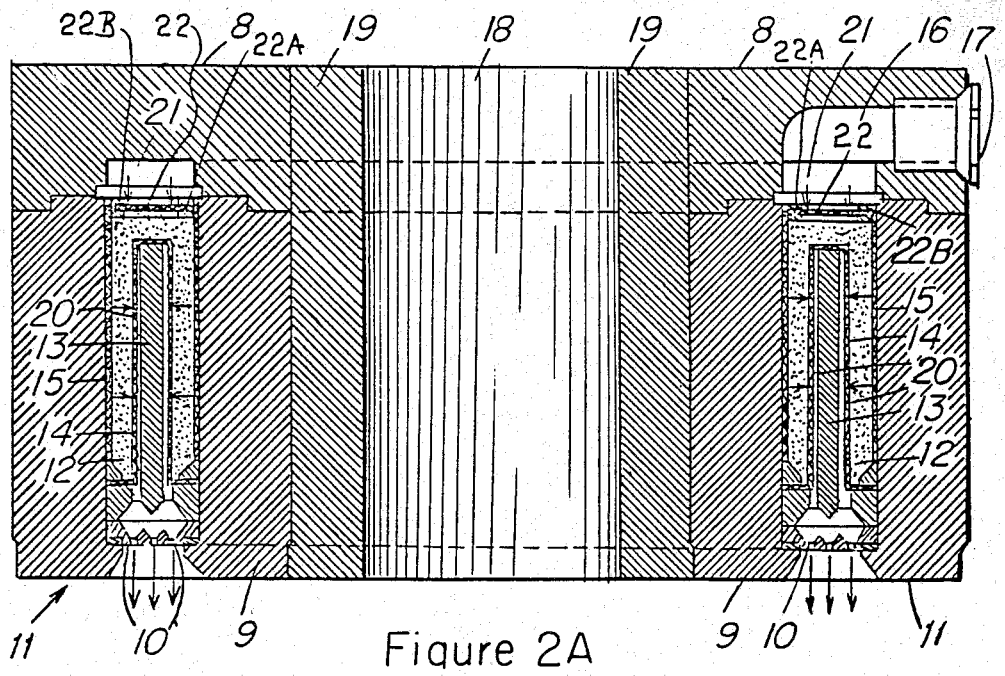
Figure 2A (PRIOR ART)
FIGS. 2A and 2B are, respectively, a front elevation view in cross-section, and a plan view, of a prior art melt-spinning pack (as shown in U.S. application Ser. No. 06/281,739, filed July 9, 1981, and now U.S. Pat. No. 4,405,548.
Figure 2B:
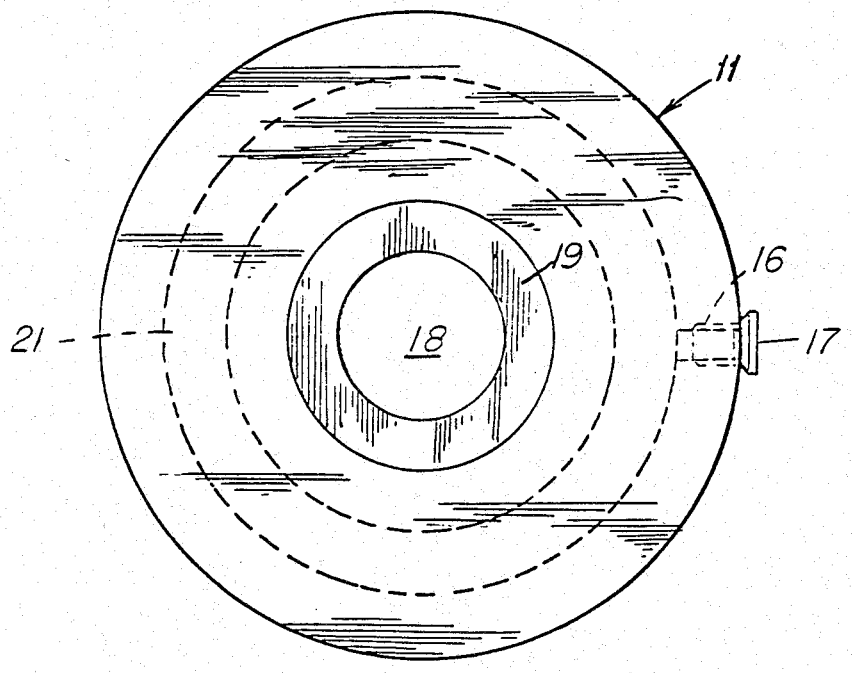
Figure 2B (PRIOR ART)
Figure 6C:
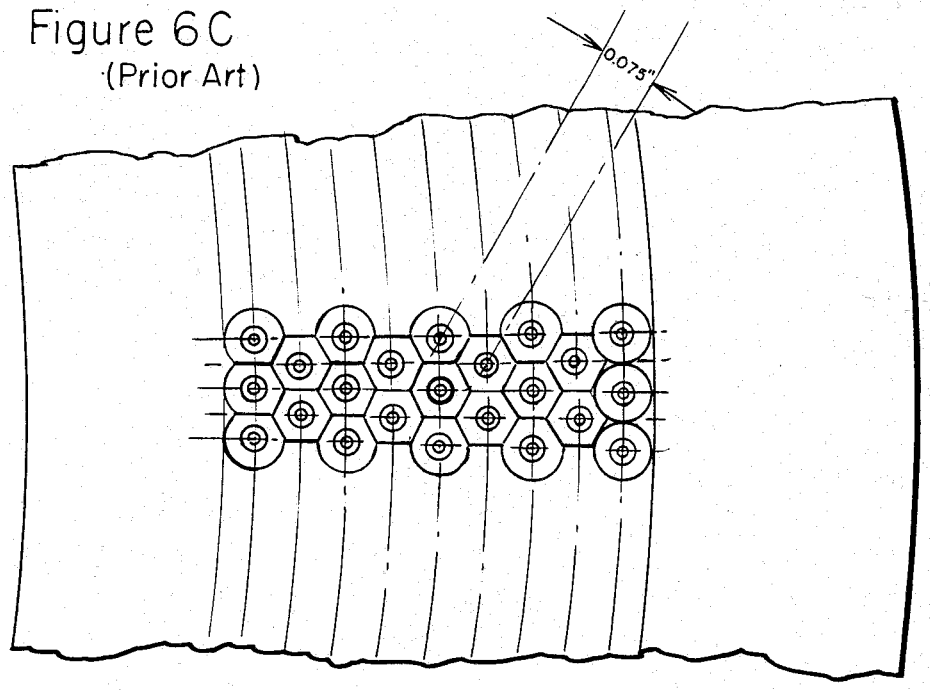
Figure 6C (Prior Art)
FIG. 6C is an enlargement of Zone Z of FIG. 6A, wherein all orifices of the spinnerette have the same diameter.

In all the Examples 1-31 and in all the corresponding Comparative Examples C13-C31, the following processing conditions were used. Melt-spun polyester filaments were made essentially according to the process shown semi-schematically in elevation in FIG. 1 (which is also FIG. 1 of U.S. Pat. No. 4,332,764). The processes used an annular melt-spinning pack similar in principle to that shown in FIGS. 2A and 2B (and which correspond to FIGS. 1 and 2 respectively of U.S. Pat. No. 3,307,216). The polymer was extruded through spinnerettes that conformed to FIGS. 6A-6C. Each spinnerette had 2,250 orifices arranged in nine circular concentric staggered rows. The average spacing between orifices was 0.075 inches.

Figure 6D:
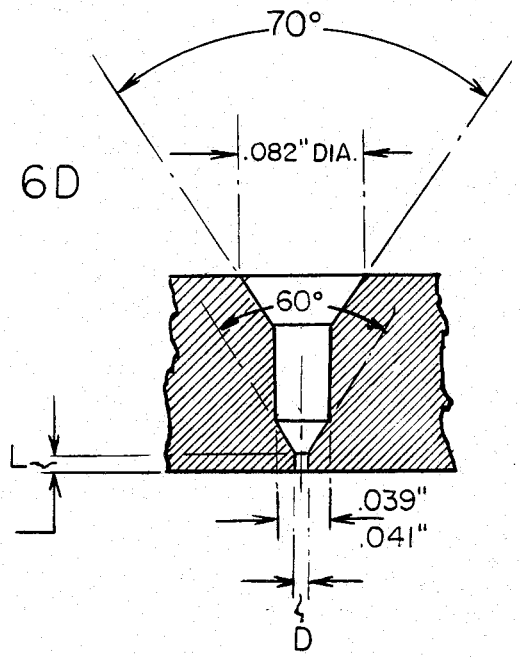
FIG. 6D is an enlarged front elevation view in cross-section of a single spinnerette orifice of length, L, and diameter, D.

The sole intended difference between the processing conditions between, say, Example 25 and the corresponding Comparative Example C25, related to the orifice dimensions shown in FIG. 6D (note, however, the dpf spread in Examples 13-16). In particular, in all the Comparative Examples, all of the orifices had capillary diameter ("D" of FIG. 6D) of 0.009±0.0001 inches. In contrast, in all the Examples 1-31, the innermost three rows of orifices had orifices all of which had been enlarged to a capillary diameter D of 0.010±0.0001 inches. Consequently, because of the pre-existing counterbore of 60° immediately upstream of the capillary, the length of the capillary, L, was also increased by about $0.0005\times\sqrt{3}$ inches to 0.0129±0.001 inches. Likewise, the middle three rows of orifices in Examples 1-31 had orifices enlarged to a capillary diameter, D, of 0.0095±0.0001 inches, and capillary length, L, of 0.012±0.001 inches.

Tables 2A, 2B and 2C below summarize the processing conditions used in the melt-spinning of poly(ethylene terephthalate) polymer having an intrinsic viscosity of about 0.62 deciliters/gram. Further, the quench stick (30 of FIG. 1) had an effective length of 12 inches. And the flow profile of air emerging horizontally and radially from the quench stick was approximately flat in the top six inches decreasingly approximately linearly by two thirds between the midpoint of the stick and the bottom of the stick. It should also be noted that in Examples 10-12, the turning guide 17 of FIG. 1 was freely rotatable by the yarn 15. Whereas in Examples 1-9 and 13-31 turning guide 17 was fixed.

Tables 2A, 2B and 2C also summarize the properties of the melt-spun poly(ethylene terephthalate) yarn obtained.

Figure 7A:
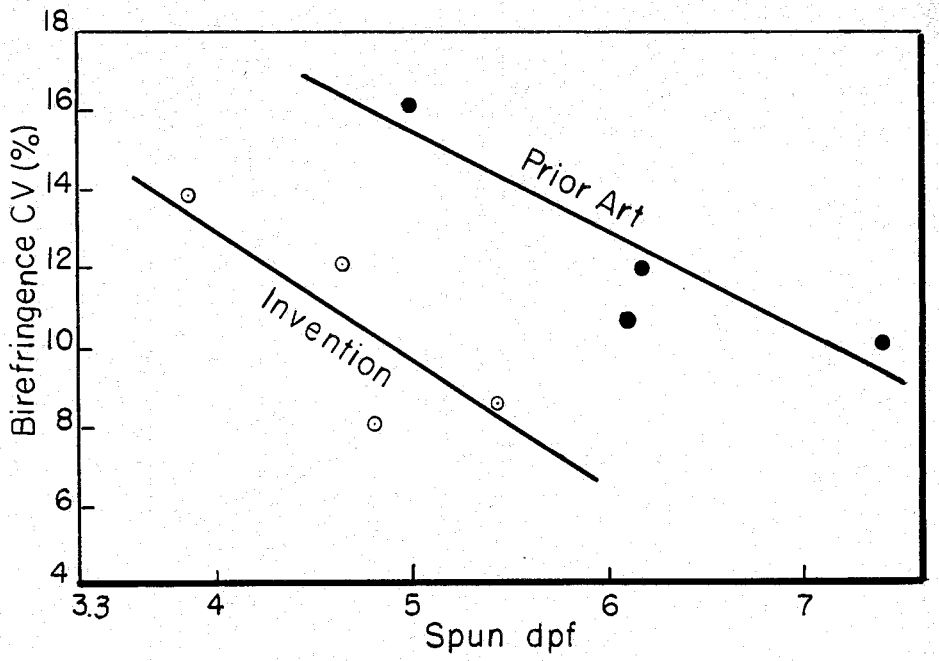
FIG. 7A is a graph showing the combined values of filament birefringence variability and filament dpf, and contrasting the prior art to the invention.
Figure 7B:
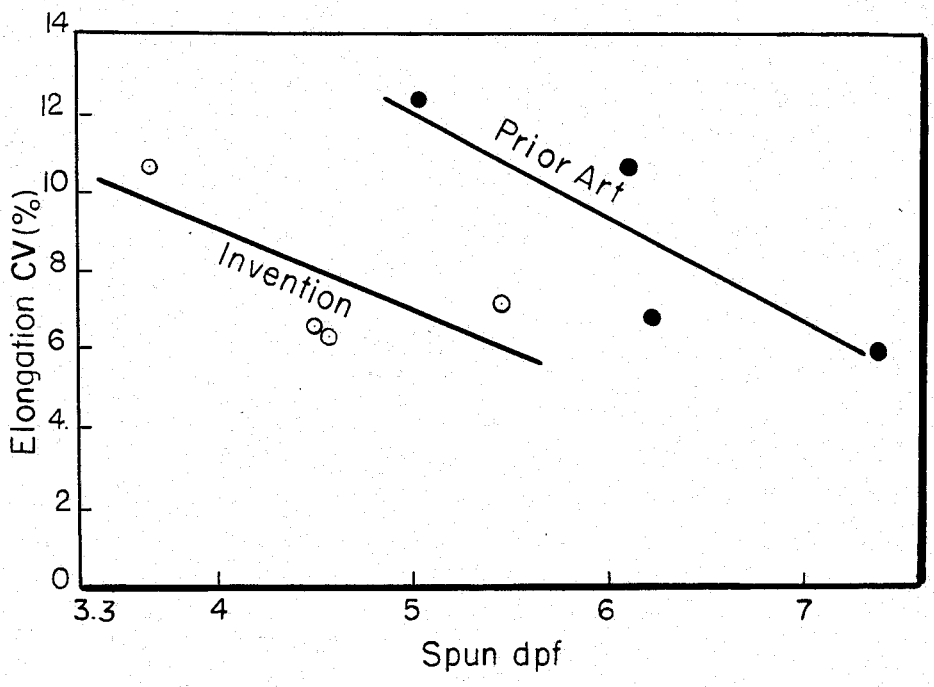
FIG. 7B is a graph showing the combined values of filament elongation variability and filament dpf, and contrasting the prior art to the invention.
Figure 8A:
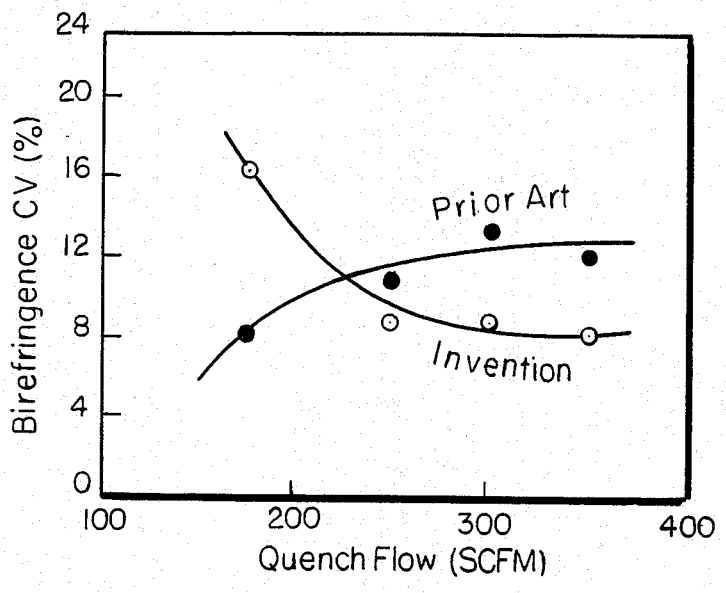
FIG. 8A is a graph showing the dependence of filament birefringence variability upon quench flow rate, for both the prior art and the invention.
Figure 8B:
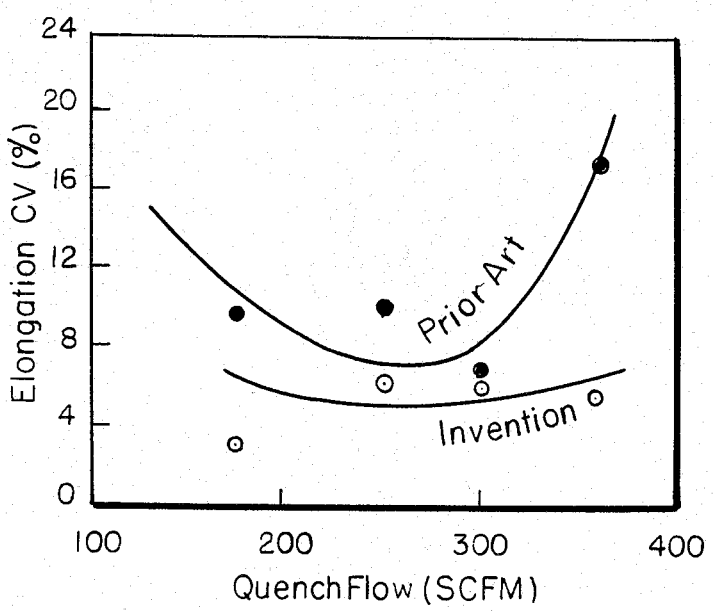
FIG. 8B is a graph showing the dependence of filament elongation variability upon quench flow rate, for both the prior art and the invention.

Some of the product property data shown in Tables 2B and 2C is plotted in graphical form in some of the Figures. In particular, FIGS. 7A and 7B both relate to Examples 13-16 and Comparative Examples C13-C16. FIGS. 8A and 8B both relate to Examples 17-20 and Comparative Examples C17-C20.

Essentially, clearly, use of the process invention claimed hereinafter has resulted in the production of a yarn of melt-spun filaments in which, as compared with the Comparative Examples, the elongation variability and the birefringence variability are both greatly reduced and the denier variability is greatly increased.

TABLE 2A

SPINNING CONDITIONS AND FIBER PROPERTIES (TRIAL 1)

| EXAMPLE NO. | WINDUP SPEED (FPM) | SPUN DPF MEAN | SPUN DPF ST. DEV. | BIREFRINGENCE MEAN | BIREFRINGENCE CV | ELONGATION MEAN % | ELONGATION CV |
|---|---|---|---|---|---|---|---|
| 1 | 3000 | 3.91 | 0.43 | 5.80 | 5.5 | 361 | 3.2 |
| 2 | 3000 | 4.41 | 0.61 | 5.97 | 5.7 | 344 | 4.2 |
| 3 | 3000 | 5.44 | 0.73 | 5.78 | 4.3 | 374 | 4.2 |
| 4 | 5000 | 3.24 | 0.43 | 13.8 | 10.9 | 252 | 6.6 |
| 5 | 5000 | 3.66 | 0.36 | 13.4 | 6.4 | 251 | 5.3 |
| 6 | 5000 | 3.96 | 0.37 | 14.5 | 8.4 | 253 | 7.4 |
| 7 | 7000 | 2.67 | 0.30 | 26.2 | 5.5 | 174 | 5.7 |
| 8 | 7000 | 2.99 | 0.44 | 27.1 | 11.7 | 183 | 6.5 |
| 9 | 7000 | 3.34 | 0.32 | 29.4 | 14.6 | 164 | 19.9 |
| 10* | 3000 | 3.85 | 0.46 | 5.88 | 6.6 | 361 | 5.0 |
| 11* | 5000 | 2.95 | 0.26 | 14.7 | 4.0 | 243 | 8.9 |
| 12* | 7000 | 2.66 | 0.32 | 27.8 | 9.3 | 183 | 10.3 |

*Turning guide was rotating rather than fixed

TABLE 2B

SPINNING CONDITION AND FIBER PROPERTIES (TRIAL 2)

| EXAMPLE NO. | QUENCH FLOW (SCFM) | FINISH APPLICATOR | SPUN DPF MEAN | SPUN DPF STD. DEV. | BIREFRINGENCE MEAN | BIREFRINGENCE CV | ELONGATION MEAN % | ELONGATION CV |
|---|---|---|---|---|---|---|---|---|
| 13 | 325 | Spray | 3.63 | 0.46 | 6.04 | 13.9 | 352 | 10.7 |
| C13 | 325 | Spray | 5.01 | 0.28 | 3.89 | 16.2 | 390 | 12.3 |
| 14 | 325 | Spray | 4.47 | 0.52 | 5.93 | 8.15 | 355 | 6.6 |

TABLE 2B-continued

| EXAMPLE NO. | QUENCH FLOW (SCFM) | FINISH APPLICATOR | SPUN DPF MEAN | SPUN DPF STD. DEV. | BIRE-FRINGENCE MEAN | BIRE-FRINGENCE CV | ELONGATION MEAN % | ELONGATION CV |
|---|---|---|---|---|---|---|---|---|
| | SPINNING CONDITION AND FIBER PROPERTIES (TRIAL 2) | | | | | | | |
| C14 | 325 | Spray | 6.09 | 0.36 | 3.50 | 12.0 | 405 | 10.7 |
| 15 | 325 | Metered | 4.51 | 0.45 | 6.05 | 12.1 | 344 | 6.5 |
| C15 | 325 | Metered | 6.21 | 0.41 | 3.72 | 10.7 | 444 | 6.9 |
| 16 | 325 | Spray | 5.44 | 0.38 | 5.41 | 8.7 | 378 | 7.2 |
| C16 | 325 | Spray | 7.38 | 0.57 | 3.50 | 11.1 | 455 | 6.0 |
| 17 | 175 | Spray | 6.06 | 0.71 | 3.59 | 16.4 | 442 | 3.1 |
| C17 | 175 | Spray | 6.01 | 0.40 | 3.89 | 8.5 | 422 | 9.7 |
| 18 | 250 | Spray | 6.02 | 0.60 | 3.50 | 9.2 | 448 | 6.4 |
| C18 | 250 | Spray | 6.03 | 0.46 | 3.87 | 11.4 | 404 | 10.3 |
| 19 | 300 | Spray | 6.06 | 0.52 | 3.70 | 9.2 | 419 | 6.0 |
| C19 | 300 | Spray | 6.02 | 0.40 | 3.98 | 13.8 | 423 | 7.0 |
| 20 | 350 | Spray | 6.08 | 0.63 | 3.63 | 8.8 | 435 | 5.8 |
| C20 | 350 | Spray | 6.02 | 0.32 | 3.83 | 12.8 | 425 | 17.6 |

TABLE 2C

| EXAMPLE NO. | DOW TEMP. (°C.) | WINDUP SPEED (fpm) | QUENCH SPACING (in.) | SPUN DPF MEAN | SPUN DPF CV | BIRE-FRINGENCE MEAN | BIRE-FRINGENCE CV | ELONGATION MEAN % | ELONGATION CV |
|---|---|---|---|---|---|---|---|---|---|
| | SPINNING CONDITIONS AND FIBER PROPERTIES (TRIAL 3) | | | | | | | | |
| 21 | 285 | 4150 | 1 | 4.07 | 8.8 | 11.2 | 6.2 | 294 | 6.0 |
| C21 | 285 | 4150 | 1 | 4.10 | 9.1 | 11.3 | 7.2 | 267 | 6.2 |
| 22 | 290 | 4150 | 1 | 4.06 | 8.7 | 10.5 | 4.3 | 298 | 7.4 |
| C22 | 290 | 4150 | 1 | 4.07 | 10.4 | 11.4 | 6.7 | 290 | 6.9 |
| 23 | 295 | 4150 | 1 | 4.06 | 10.0 | 10.2 | 4.3 | 302 | 3.6 |
| C23 | 295 | 4150 | 1 | 4.07 | 8.6 | 10.7 | 6.3 | 299 | 5.6 |
| 24 | 300 | 4150 | 1 | 4.05 | 12.7 | 10.4 | 4.6 | 300 | 5.6 |
| C24 | 300 | 4150 | 1 | 4.04 | 8.1 | 10.2 | 4.0 | 293 | 6.8 |
| 25 | 305 | 4150 | 1 | 4.05 | 14.5 | 9.8 | 3.8 | 318 | 4.7 |
| C25 | 305 | 4150 | 1 | 4.06 | 14.0 | 10.4 | 8.2 | 321 | 5.7 |
| 26 | 305 | 6000 | 1 | 3.47 | 9.3 | 19.5 | 7.1 | 224 | 7.1 |
| C26 | 305 | 6000 | 1 | 3.49 | 8.6 | 18.6 | 3.8 | 230 | 4.4 |
| 27 | 305 | 5000 | 1 | 3.76 | 8.0 | 13.9 | 5.2 | 278 | 3.8 |
| C27 | 305 | 5000 | 1 | 3.76 | 8.5 | 14.7 | 6.4 | 263 | 7.6 |
| 28 | 305 | 3000 | 1 | 4.90 | 10.5 | 6.1 | 5.1 | 369 | 3.6 |
| C28 | 305 | 3000 | 1 | 4.91 | 10.3 | 6.1 | 7.1 | 373 | 4.1 |
| 29 | 305 | 4150 | 1 | 4.06 | 11.6 | 10.1 | 4.7 | 305 | 5.8 |
| C29 | 305 | 4150 | 1 | 4.05 | 8.6 | 10.4 | 7.6 | 314 | 5.1 |
| 30 | 305 | 4150 | 2 | 4.05 | 11.5 | 8.6 | 7.2 | 332 | 6.8 |
| C30 | 305 | 4150 | 2 | 4.06 | 6.7 | 9.1 | 7.7 | 331 | 4.7 |
| 31 | 305 | 4150 | 3 | 4.06 | 17.2 | 7.8 | 13.1 | 354 | 4.3 |
| C31 | 305 | 4150 | 3 | 4.05 | 10.9 | 8.4 | 8.3 | 350 | 5.5 |

All the foregoing examples of the invention relate to poly(ethylene terephthalate) polymer spun from a single specific spinnerette and single quench system. However, the invention also clearly relates to other melt-spun polymers (such as polyamides and polyolefins); other shapes of orifice (such as non-circular orifices); and other orifice arrangements (such as linear rows of orifices). It seems likely that the best way of practicing the invention for such other systems, would be to parallel the previously described procedures now used with success for melt-spinning polyester polymer through circular orifices.

What we claim is:

1. An improved process for melt-spinning polymeric filaments comprising (1) extruding the same molten polymer through at least two groups of orifices in a single spinnerette, wherein each group of orifices is arranged in at least one row; (2) directing quench vapor or gas successively across the first group of filaments and thence across the second group of filaments; (3) thereafter collecting partially oriented filaments; wherein the improvement comprises:

extruding at an average mass-flow rate of polymer through the second group of orifices, $m_2$, that is less than the average mass-flow rate of polymer through the first group of orifices, $m_1$, whereby there is less difference in degree of orientation between the first group of melt-spun filaments and the second group of melt-spun filaments.

2. The process of claim 1 whereby the stress profile along the length of the filament within any one group of filaments closely approximates the stress profile along the length of the filament within the other groups of the filaments.

3. The process of claim 1 which comprises increasing the mass-flow rate of polymer through the first group of orifices by adjusting the dimensions of the orifices of the first group of orifices.

4. The process of claim 3 wherein the orifices within each group comprise capillaries, and which process further comprises increasing the cross-sectional area of the capillaries of the first group of orifices.

5. The process of claim 3 wherein the orifices within each group comprise capillaries and which comprises reducing the length of the capillaries in the first group.

6. The process of claim 3 which comprises extruding poly(ethylene terephthalate) polymer having an intrinsic viscosity within the range of 0.4 to 1.0 deciliters/gram; quenching the filaments; and thereafter collecting the partially oriented filaments at a speed within the range from 1,500 to 12,000 feet/minute.

7. The process of claim 4 which comprises extruding the polymer through groups of circular capillaries having diameters within the range from 0.006 inches to 0.030 inches, and wherein the diameter of the orifices of the first group of orifices $d_1$, is greater than the diameter of the orifices of the second group of orifices, $d_2$, by an amount such that $d_1/d_2$ is in the range from 1.03 to 1.20.

8. The process of claim 3 which comprises extruding polymer through at least 1000 orifices in a single spinnerette and wherein at least one group of orifices comprises at least two circular rows of orifices.

9. The process of claim 1 which comprises extruding molten polymer through orifices in a single spinnerette at a total extrusion rate of at least 50 lbs/hour.

10. The process of claim 6 which comprises quenching the extruded filaments in radial outflow manner.

11. The process of claim 10 which comprises quenching the melt-spun filaments with air at a rate within the range of 1.5 to 2.5 SCFM per lb/hour of molten polymer.

* * * * *